US005777296A

United States Patent [19]

Bell

[11] Patent Number: 5,777,296

[45] Date of Patent: Jul. 7, 1998

[54] ELECTRICALLY HEATED GARMENT

[76] Inventor: Jerome Bell, 5731 S. Princeton, Chicago, Ill. 60621

[21] Appl. No.: 714,691

[22] Filed: Sep. 16, 1996

[51] Int. Cl.[6] ..... H05B 3/34

[52] U.S. Cl. ..... 219/211; 219/529

[58] Field of Search ..... 219/211, 212, 219/527, 528, 529, 548, 549, 545

[56] References Cited

U.S. PATENT DOCUMENTS

| | | | |
|---|---|---|---|
| 1,691,472 | 11/1928 | Graham et al. | 219/211 |
| 2,287,915 | 6/1942 | Taylor | 219/211 |
| 2,458,119 | 1/1949 | Van Daam | 219/211 |
| 2,584,302 | 2/1952 | Stein | 219/528 |
| 3,084,241 | 4/1963 | Carrona | 219/211 |
| 3,102,186 | 8/1963 | Owers | 219/212 |
| 4,404,460 | 9/1983 | Kerr | 219/211 |
| 4,777,344 | 10/1988 | Nash et al. | 219/211 |
| 5,008,517 | 4/1991 | Brekkestran et al. | 219/211 |
| 5,047,808 | 9/1991 | Landa et al. | 219/469 |
| 5,302,807 | 4/1994 | Zhao | 219/211 |
| 5,378,225 | 1/1995 | Chatman, Jr. et al. | 219/528 |

*Primary Examiner*—Teresa J. Walberg
*Assistant Examiner*—Sam Paik
*Attorney, Agent, or Firm*—Brendan Dix; David Volk

[57] ABSTRACT

A lightweight and flexible outer garment provides controllable heat from a heating element to a wearer. A soft interior lining is immediately adjacent to a wearer's skin. The outer garment includes attachable gloves and boots providing complete covering of a wearer. A belt positioned around the outer garment includes a clasp which when connected enables the heating elements to provide heat to a wearer.

18 Claims, 2 Drawing Sheets

ELECTRICALLY HEATED GARMENT

BACKGROUND OF THE INVENTION

1. References to Other Applications

This application is a substitute for Ser. No. 08/289,518, filed Aug. 21, 1994 now abandoned.

2. Field of the Invention

The present invention relates to clothing, particularly to electrical heated clothing.

3. Description of the Prior Art

In the prior art there are many heated garments. Electrically heated garments, or portions thereof, are helpful in combating the effects of prolonged exposure to cold weather.

A drawback of many prior heat garments is the fabric used for the garment itself. Ideally, the fabric should be light in weight and not bulky to maximize the flexibility of the wearer during physical activity. The fabric should have excellent insulating capability, be stretchable, and be capable of rapidly absorbing and evaporating moisture and perspiration from the skin of the wearer. Many prior art heated garments suffer from a lack of one or more of these features.

There is a need for a heated garment in many sports and other activities, such as motorcycling, snowmobile operation and the operation of construction equipment out of doors in cold climates.

Thermal garments are normally provided with internal heating elements. An electrical current directed to a heating element will cause the same to heat the garment and the body on which the garment is disposed.

In order to make thermal garments of this nature practical and useful, it has been necessary to utilize battery power so that the garment can be worn away from a conventional AC power supply. This has given rise to a drawback and disadvantage in thermal garments and has generally discouraged the wide use and acceptance of such. Specifically, an appropriate battery package is often heavy and cumbersome and with a relatively short life.

Consequently, thermal garments have not been readily accepted, despite many advantages. Thermal garments can be worn within a dwelling during winter and the dwelling thermostat can be set at a minimum while the occupants within are warm and comfortable, thereby saving energy while maintaining comfort.

In the same regard, the utility of thermal garments for outdoor use, either while participating in recreation or at work, is obviously substantial.

SUMMARY OF THE INVENTION

It is a principal object of the invention to provide a lightweight, stretchable, form-fitting, selectively heated outer garment for use in cold weather, such that the garment allows excellent range of movement to a wearer. The heated outer garment includes heating element means incorporated therein and a battery package power source; thus, the wearer can move freely and remain dry and warm in inclement weather.

A further object of the present invention resides in the provision of a battery powered thermal garment provided with a battery package that is relatively light and easy to handle, thereby adding substantial portability for indoor and outdoor use.

It is a still further object of the present invention to provide an outer garment which is substantially waterproof thereby allowing the wearer to proceed outside in the rain or inclement weather.

Another object of the present invention is to provide a heating element which withstands repeating bending stresses.

Still another object of the present invention is to provide means for controlling battery powered electrical current flow to the heating elements, which includes a clasp connected in series with one of more of the heater elements for interrupting current flow thereto.

It is still another object of the present invention that the electrical heating element may be characterized by a wire of ductile metal coated with an insulating lacquer, for example, a copper wire.

Another feature of the present invention is that said present invention will readily be perceived hereafter.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

DETAILED DESCRIPTION

Figure 1:
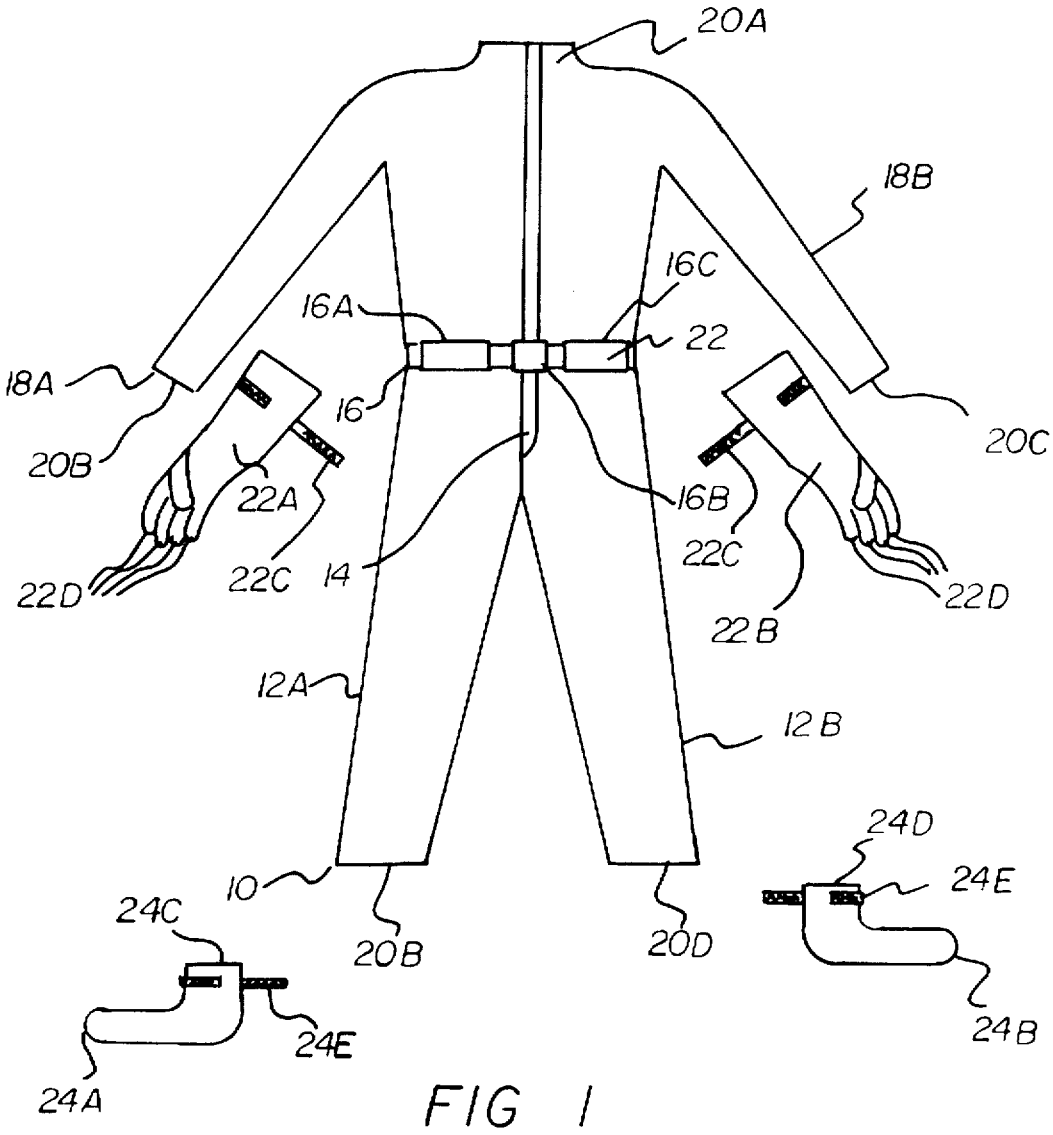
FIG. 1 is a front view of a thermo-suit including right and left gloves and boots.

FIG. 1 is a front view of a thermo-suit 10 including a right pants leg 12A, a left pants leg 12B, a right sleeve 18A and a left sleeve 18B, all being securely waterproofly fastened to the thermo-suit 10.

A front fastener 14 is attached to the thermo-suit 10. A belt 16 is fastened around the thermo-suit 10 and includes a first powering means 16A, a clasp 16B, and a second powering means 16C fastened to the belt 16. The clasp 16B is configured to securely fasten one distal end of the belt 16 to the opposite distal end of the belt 16.

A neck opening 20A is located at a top middle distal end of the thermo-suit 10. A right sleeve opening 20B is located at a terminal distal end of the right sleeve 18A, and a left sleeve opening 20C is located at a terminal distal end of the left sleeve 18B. A right glove 22A and a left glove 22B are securely, waterproofly and removably attachable to the right sleeve 18A and the left sleeve 18B respectively.

Each of the gloves 22A, 22B includes a glove fastener 22C securely, waterproofly and removably fastened thereon and a finger portion 22D positioned at a terminal distal end of the gloves 22A, 22B to accept a person's fingers therein. The glove fasteners 22C may include a material such as Velcro™.

Figure 2:
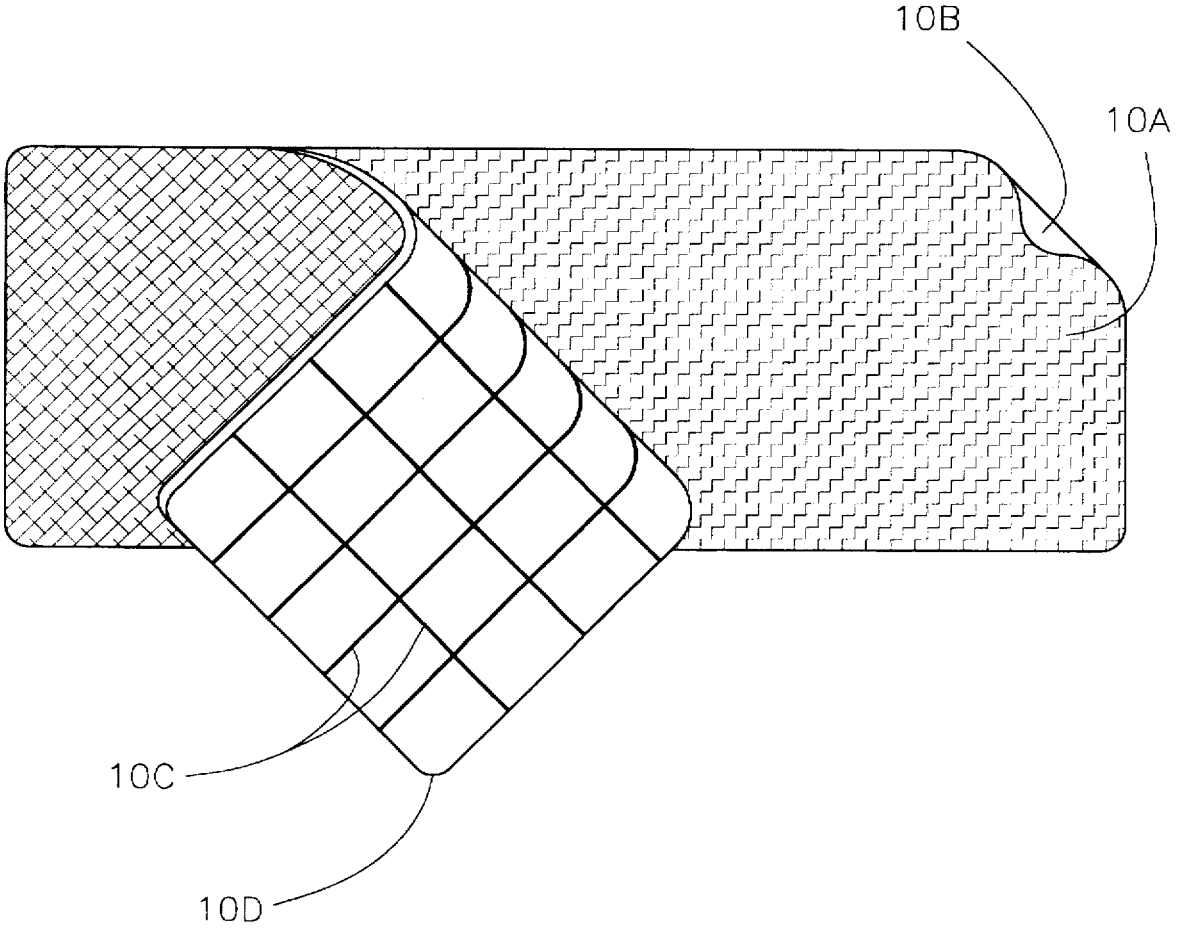
FIG. 2 is a perspective view of the construction of the thermo-suit showing an interior lining, a waterproof exterior portion, and heating elements disposed therebetween.

FIG. 2 is a perspective view of the construction of the thermo-suit 10 showing a soft interior lining 10B, a waterproof exterior portion 10D, and heating elements 10C disposed there-between. An adhesive portion 10A is positioned between the interior lining 10B and the heating elements 10C.

The thermo-suit 10 is a lightweight, flexible garment which provides controllable heat from the heating element 10C to a wearer. The soft interior lining 10B is immediately adjacent to a wearer's skin and provides maximum comfort. The heating element 10C is a wire of ductile metal coated with an insulating lacquer. Further, the heating element 10C may comprise very thin wire, consisting for example of copper, which withstands repeated bending, providing for flexibility in the garment.

The gloves 22A, 22B provide removable, flexible covering of a wearer's hands. The gloves 22A, 22B may include a material such as Neoprene™. The boots 24A, 24B provide removable, flexible covering of a wearer's feet. The boots 24A, 24B are removably fastenable to the right and left pants legs 12A, 12B respectively. The boots 24A, 24B each include a boot fastener 24E which may include a material such as Velcro™.

The first and second powering means 16A, 16C and the clasp 16B complete an electrical circuit which provides current to the heating element 10C. The clasp 16B is connected in series with one or more if the heating elements 10C for interrupting current flow thereto. The current is readily stopped by undoing the clasp 16B which may be refastened when heat is desirable. This provides the advantage of ensuring that the current is turned off whenever the thermo-suit 10is removed from a wearer's body.

The waterproof exterior portion 10D may include layers providing enhanced water proofness. Further, the layers may include a material such as Neoprene™.

The forgoeing desription is intended to illustrate a preferred embodiment of the present invention, and is not intended to limit the scope of invention. It will be understood to one skilled in the art that various omissions, modifications, substitutions and changes in the forms and details of the device illustrated and in its operation can be made without departing from the spirit of the invention. What is new and desired to be protected by Letters Patent is set forth in the appended claims.

I claim:

1. A heated outer garment comprising:

a. a body portion composing of flexible material having a neck opening located at a top middle distal end of the heated outer garment, the body portion further having a securable opening providing ease of access into and out of the heated outer garment;

b. a plurality of sleeves consisting of a left and a right sleeve having proximal ends attached to the body portion and terminal distal ends having openings which a person's hands are extended there-through;

c. a plurality of pant legs consisting of a left and right pant leg having proximal ends attached to the body portion and terminal distal ends having openings which a perons's feet are extended there-through;

d. a plurality of heating elements securely fastened within an interior lining positioned throughout the heated outer garment, the heated outer garment having an exterior portion;

e. powering means for providing electric current to the plurality of heating elements to produce heat in the heated outer garment;

f. means for controlling output of the electrical current to the plurality of heating elements;

g. a belt positioned circumferentially around the body portion of the heated outer garment and including a buckle clasp; and h. switching means for connecting and disconnecting the powering means to the plurality of heating elements, the switching means disposed in the buckle clasp of the belt so that the electric current to the plurality of heating elements flows when the buckle clasp of the belt is fastened to allow the pluality of heating elements to generate heat and the electric current to the plurality of heating elements does not flow when the buckle clasp of the belt is unfastened so as not to allow the plurality of heating elemtents to generate heat.

2. The heated outer garment of claim 1, wherein the plurality of heating elements have an adhesive portion disposed between the intereior lining and the plurality of heating elements, the adhesive portion holding the heating elements in position thereon.

3. The heated outer garment of claim 1, wherein the exterior portion has a plurality of layers.

4. The heated outer garment of claim 3, wherein the exterior portion is waterproof.

5. The heated outer garment of claim 3, wherein the plurality of layers of the exterior portion are manufactured from waterproof materials having thermal insulating characteristics.

6. The heated outer garment of claim 1, wherein the interior lining has soft material so as to be comfortable when in contact with a person's body therein.

7. The heated outer garment of claim 1, wherein the heated outer garment has right and left hand gloves which are waterproofly and removably attachable to a distal end of the right and the left sleeves.

8. The heated outer garment of claim 7, wherein the right and the left hand gloves have finger portions positioned at a distal end of the right and the left hand gloves functioning to accept a person's fingers therein.

9. The heated outer garment of claim 8, wherein the right and the left hand gloves are manufactured from waterproof materials having htermal insulating characteristics.

10. The heated outer garment of claim 9, wherein the right and the left hand gloves have a fastening element for attachment to the distal end of the sleeve.

11. The heated outer garment of claim 10, wherein the fastening element for attachment to the distal end of the sleeve is selected from a group consisting of snaps, buttons, and attachable and flexible fastening means.

12. The heated outer garment of claim 11, wherein the right and the left hand gloves are a mitt positioned at a distal end of the right and the left sleeves functioning to accept a person's fingers therein.

13. The heated outer garment of claim 12, wherein the heating elements are constructed of a material selected from a group consisting of copper, aluminum, zinc, nickel stainless steel, and metal alloys.

14. The heated outer garment of claim 1, further including right and left boots waterproofly and removably attachable to distal ends fo the right and left pant legs to accept a person's foot therein.

15. The heated outer garment of claim 14, wherein the right and left boots are manufactured from waterproof materials having thermal insulating characteristics.

16. The heated outer garment of claim 15, wherein the right and left boots have a fastening element for attachment to the distal end of the pant leg.

17. The heated outer garment of claim 16, wherein the fastening element is selected from a group of materials consisting of hook and loop, snaps, buttons, and reattachable and flexible fastening means.

18. The heated outer garment of claim 1, wherein the heating element comprises wire of ductile metal coated with an insulating lacquer.

* * * * *